United States Patent [19]

West

[11] Patent Number: 4,937,143

[45] Date of Patent: Jun. 26, 1990

[54] COMPOSITIONS AND PROCESSING FOR PRESERVING AND/OR COLORING WOOD

[75] Inventor: Michael H. West, Senatobia, Miss.

[73] Assignee: Chapman Chemical Company, Memphis, Tenn.

[21] Appl. No.: 245,168

[22] Filed: Sep. 16, 1988

[51] Int. Cl.[5] ..... B05D 1/36

[52] U.S. Cl. ..... 427/419.8; 427/297; 427/303; 427/308; 427/317; 427/325

[58] Field of Search ..... 427/297, 419.8, 303, 427/308, 317, 325

[56] References Cited

U.S. PATENT DOCUMENTS

| | | | |
|---|---|---|---|
| 1,963,975 | 6/1934 | Ellis | 427/419.8 |
| 4,313,976 | 2/1982 | Leach | 427/297 |
| 4,364,976 | 12/1982 | Prokofievna et al. | 427/297 |
| 4,591,515 | 5/1986 | Dickinson et al. | 427/297 |
| 4,684,663 | 8/1987 | Plum et al. | 514/493 |
| 4,786,326 | 11/1988 | Grove | 427/297 |

*Primary Examiner*—Stanley Silverman
*Attorney, Agent, or Firm*—Fred Philpitt

[57] ABSTRACT

A method for both preserving and coloring wood which comprises in a first step contacting the wood with a liquid composition containing a biocidally effective amount of a copper compound, and in a second step contacting the wood with a liquid composition containing a biocidally effective amount of a dithiocarbamate compound selected from the group consisting of alkyl dithiocarbamates, alkylene dithiocarbamates and soluble salts thereof.

10 Claims, No Drawings

COMPOSITIONS AND PROCESSING FOR PRESERVING AND/OR COLORING WOOD

This invention relates to a new process for preserving and coloring wood in its natural and reconstituted forms.

It is recongized that the market offers a large number of wood preservatives, employed in one form or another, to provide protection from wood destroying organisms. However, nearly half of all wood treated is treated with acidic compositions of copper, chrome, and arsenic; i.e. the C.C.A. preservatives. While C.C.A. provides excellent decay and insect protection at relatively low cost, there are many drawbacks to its continued use.

C.C.A. treatments leave the wood a green color and this is undesirable for many applications. This inorganic preservative does not prevent molds and certain other staining organisms from growing on the wood. Hardwoods, treated with C.C.A., are particularly subject to soft rot. When C.C.A. treated wood is burned, poisonous gases can be released and the ashes can be dangerously high in water soluble arsenic. The E.P.A. has determined that pesticide products containing inorganic arsenic meet or exceed the risk criteria relating to oncogenic effects, mutagenic effects, and reproductive or fetotoxic effects on mammalian test species.

Considered from one aspect the present invention is directed to a two step method for both preserving and coloring wood which comprises (a) in one step contacting the wood with a liquid composition containing a biocidally effective amount of a copper compound, and (b) in another separate step contacting the wood with a liquid composition containing a biocidally effective amount of a dithiocarbamate compound selected from the group consisting of alkyl dithiocarbamates, akylene dithiocarbamates and soluble salts thereof.

The copper compound may be any biocidally effective copper compound and preferred examples are acid copper chromate, copper ammonium carbonate, copper sulfate, acid copper phosphate, copper naphthenate or a copper ethanolamine complex. The copper compound may be dissolved in any suitable liquid such as water or a hydrocarbon. The amount of the copper compound should preferably be in excess of that required to react with all of the dithiocarbamate so as to form a copper salt of the dithiocarbamate, e.g. copper dimethyl dithiocarbamate. This can readily be determined by routine experimentation.

The biocidal dithiocarbamate compound may be any of the known biocidally effective dithiocarbamates and preferably sodium dimethyl dithiocarbamate, potassium dimethyl dithiocarbamate, disodium ethylenebis dithiocarbamate, potassium N-hydroxymethyl dithiocarbamate, sodium N-methyl dithiocarbamate, etc.

The alkyl dithiocarbamates are preferred over the alkylene dithiocarbamates so long as the contaminents of latter are suggested as being possible carcinogens.

The dithiocarbamate may be dissolved in water, a chlorinated hydrocarbon or any liquid that will facilitate penetration of the dithiocarbamate into the wood.

The dithiocarbamates form water insoluble salts or chelates when brought into contact with the copper compound.

The sequence of applying the two steps can be varied. Either the copper biocide or the dithiocarbamte biocide can be used in the first step. The decision as to which one is used in the first step may depend upon the particular wood being treated, the equipment available, the solvent used, etc. Simple experimentation can determine which chemical it is preferable to use in the first step. In some experiments I have found it advantageous to use the copper compound first because it penetrates more deeply into the wood.

My two-step process requires extra equipment, but this is amply compensated for by the ability to offer wood with beauty and weathering properties that are not possible with a single CCA treatment. Brown tones of varying intensities are easily achieved. By adding oils to the final treatment the best properties of both oil and water based preservatives are meshed.

The two treatments can each be accomplished by vacuum, pressure, soaking, brushing, spraying, or combinations of these methods. Retentions of chemicals in the wood depends upon many factors including treating solution concentration, treatment procedure and condition of the wood prior to treatment. It is possible to dry the wood after the initial treatment and before the second treatment, but it will be evident to those working in the art that using an "empty cell" treatment for the initial application accomplishes much the same purpose.

Copper complexes of the dithiocarbamates formed as the result of the two-step processs are brownish in color. The combination of copper with the dimethyldithiocarbamates gives a particularly pleasing brown color. When color development is of primary importance, it is desirable to use the dithiocarbamate composition for the final treatment. Where only color is of importance this can be accomplished at a fraction of the cost required when using pigment and dye systems.

The compositions and treating procedures of the present invention overcome many of the drawbacks of C.C.A. treatments without seriously increasing the cost of the treated wood. In the practice of the present invention the wood can be colored a pleasing brown, surface fungi growth and soft rots can be inhibited, and the need for inorganic arsenic in the treatments can be eliminated.

In addition to the copper compound and the dithiocarbamate, the wood treating compositions of this invention may also include known wood treating materials such as naphthemic acids, alkyl ammonium compounds, etc.

Flameproofing qualities can be imparted to the wood in many different ways. Phosphates, borates, and bromophenols can be incorporated with certain of the copper biocides. These compounds can alternately be included with the dithiocarbamates. Oils for waterproofing and weatherproofing can be emulsified into the dithiocarbamate solutions. Copper biocides dissolved in heavy oils and used as the final treatment give especially good weathering properties to the wood.

EXAMPLE 1

In a first step a Southern Yellow Pine stake was treated with a 2.5% aqueous solution of copper ammonium carbonate 8% EPA Registration No. 10465-3 and after this solution had penetrated the wood, the wood was treated in a second step with a 0.28% aqueous solution of sodium dimethyl dithiocarbamate.

EXAMPLE 2

In a first step a Southern Yellow Pine stake was treated with a 2.5% aqueous solution of copper ammonium carbonate 8% EPA Registration No. 10465-3 and after this solution had penetrated the wood, the wood was treated in a second step with a 0.33% aqueous solution of sodiuom N-methyl dithiocarbamate.

EXAMPLE 3

In a first step a Southern Yellow Pine stake was treated with a 2.5% aqueous solution of copper ammonium carbonate 8% EPA Registration No. 10465-3 and after this solution had penetrated the wood, the wood was treated in a second step with a 0.40% aqueous solution of potassium dimethyl dithiocarbamate.

EXAMPLE 4

In a first step a Southern Yellow Pine stake was treated with a 2.5% aqueous solution of cooper ammonium carbonate 8% EPA Registration No. 10465-3 and after this solution had penetrated the wood, the wood was treated in a second step with a 0.28% aqueous solution of disodium ethylenebis (dithiocarbamate).

EXAMPLE 5

In a first step a Southern Yellow Pine stake was treated with a 2.5% aqueous solution of copper ammonium carbonate 8% EPA Registration No. 10465-3 and after this solution had penetrated the wood, the wood was treated in a second step with a 0.40% aqueous solution of potassium N-hydroxymethyl-N-methyl dithiocarbamate.

EXAMPLE 6

In a first step a Southern Yellow Pine stake was treated with a 0.4% aqueous solution of sodium dimethyl dithiocarbamate and after this solution had thoroughly penetreated the stake it was treated in a second step with a 1.0% aqueous solution of CuSO4.5H20.

EXAMPLE 7

In a first step a Southern Yellow Pine stake was treated with a 0.4% aqueous solution of sodium dimethyl dithiocarbamate and after this solution had thoroughly penetrated the stake it was treated in a second step with a 4.0% aqueous solution of CuSO4.5H20.

EXAMPLE 8

In a first step a Southern Yellow Pine stake was treated with a 0.8% aqueous solution of sodium dimethyl dithiocarbamate and after this solution had thoroughly penetrated the stake it was treated in a second step with a 2.0% aqueous solution of CuSO4.5H20.

EXAMPLE 9

In a first step a Southern Yellow Pine stake was treated with a 0.8% aqueous solution of sodium dimethyl dithiocarbamate and after this solution had thoroughly penetrated the stake it was treated in a second step with a 1.0% aqueous solution of CuSO4.5H20.

EXAMPLE 10

In a first step a Southern Yellow Pine stake was treated with a 1.2% aqueous solution of sodium dimethyl dithiocarbamate and after this solution had thoroughly penetrated the stake it was treated in a second step with a 1.0% aqueous solution of CuSO4.5H20.

EXAMPLE 11

In a first step a Southern Yellow Pine stake was treated with a 1.2% aqueous solution of sodium dimethyl dithiocarbamate and after this solution has thoroughly penetrated the stake it was treated in a second step with a 0.5% aqueous solution of CuSO4.5H20.

EXAMPLE 12

In a first step Southern Yellow Pine stakes were treated with 1.0% aqueous solutions of CuSO4.5H20 and after this solution had penetrated the stakes the wood was treated in a second step with aqueous solutions of sodium dimethyl dithiocarbamate of various concentration ranging from 0.121% to 4.0%.

EXAMPLE 13

In a first step Southern Yellow Pine stakes were treated with 2.0% aqueous solutions of CuSO4.5H20 and after this solution has penetrated the stakes the wood was treated in a second step with aqueous solutions of sodium dimethyl dithiocarbamate of various concentration ranging from 0.2% to 4.0%.

The stakes in all of the above examples had good resistance to decay and termites and inhibited stain and mold growth.

I claim:

1. In a two-step method for both preserving and coloring wood which comprises (a) in one step contacting the wood with a liquid composition containing a biocidally effective amount of a copper compound, and (b) in another separate step contacting the wood with a liquid composition containing a biocidally effective amount of a dithiocarbamate compound selected from the group consisting of alkyl dithiocarbamates, akylene dithiocarbamates and soluble salts thereof.

2. A method according to claim 1 wherein the copper compound is an acid copper chromate, copper ammonium carbonate, copper sulfate, acid copper phosphate, copper naphthenate or a copper ethanolamine complex.

3. The method of claim 1 wherein the dithiocarbamate is sodium dimethyl dithiocarbamate.

4. The method of claim 1 wherein the dithiocarbamate is disodium ethylenebis dithiocarbamate.

5. The method of claim 1 wherein the dithiocarbamate is sodium N-methyl dithiocarbamate.

6. The method of claim 1 wherein the dithiocarbamate is potassium dimethyl dithiocarbamate.

7. The method of claim 2 wherein the dithiocarbamate is sodium dimethyl dithiocarbamate.

8. The method of claim 2 wherein the dithiocarbamate is disodium ethylenebis dithiocarbamate.

9. The method of claim 2 wherein the dithiocarbamate is sodium N-methyl dithiocarbamate.

10. The method of claim 2 wherein the dithiocarbamate is potassium dimethyl dithiocarbamate.

* * * * *